United States Patent [19]

Bajek et al.

[11] 4,181,084

[45] Jan. 1, 1980

[54] BUTTONHOLE BAR TACKER SEWING MACHINE WITH A DEVICE FOR CONTROLLING THE BUTTONHOLE LENGTH TERMINATED BY A WEDGE BAR TACK

[75] Inventors: František Bajerk; Josef Nejedlý, both of Prostejov, Czechoslovakia

[73] Assignee: Elitex, Koncern Textilniho Strojirenstvi, Liberec, Czechoslovakia

[21] Appl. No.: 11

[22] Filed: Jan. 2, 1979

[30] Foreign Application Priority Data

Dec. 30, 1977 [CS] Czechoslovakia ..... 9050-77

[51] Int. Cl.[2] ..... D05B 3/06

[52] U.S. Cl. ..... 112/71; 112/70

[58] Field of Search ..... 112/65, 67, 68, 70, 112/71, 72, 73, 158 B

[56] References Cited

U.S. PATENT DOCUMENTS

| | | | |
|---|---|---|---|
| 1,696,893 | 12/1928 | Kiewicz | 112/71 |
| 1,726,153 | 8/1931 | Kiewicz | 112/71 |
| 2,149,110 | 2/1939 | Avis | 112/71 |
| 2,190,614 | 2/1940 | Spaine et al. | 112/71 |
| 3,705,561 | 12/1972 | Sakawa et al. | 112/70 X |

*Primary Examiner*—H. Hampton Hunter

[57] ABSTRACT

There is disclosed a buttonhole bar tacker sewing machine with a device for controlling the length of the buttonhole terminated by a wedge bar tack, the machine having a support plate for the workpiece and control members for exerting a reverse motion in the direction of the longitudinal axis of the buttonhole. The control device comprises a first cam, a cam for forming a wedge bar tack and at least one further cam coupled in its motion with the first cam for bar tacking the eye of the buttonhole. The further cam for bar tacking the wedge bar tack of the buttonhole is arranged reversibly rotatable about its axis of rotation and adjustable in its angular position and adjustable relative to the first cam and is further reversibly coupled in its motion with the reversible motion of the support plate in the direction of the longitudinal axis of the buttonhole. The further cam is provided with a cam groove consisting of a section having a symmetrical course relative to the axis of rotation of the cam for bar tacking the wedge bar tack of the buttonhole, and a further section consisting of two parts mutually offset as to their heights, a roller mounted on a displaceable pin being inserted into said cam groove, said roller following in dependence upon its height defined position by the position of the displaceable pin the path of either one or the other of two mutually offset parts as to the height of the cam groove and following independently of the height position the path of symmetrical sections of the cam groove, each of said two height positions of the displaceable pin being defined by the angular position of the said further cam coupled in its motion with the first cam.

6 Claims, 7 Drawing Figures

BUTTONHOLE BAR TACKER SEWING MACHINE WITH A DEVICE FOR CONTROLLING THE BUTTONHOLE LENGTH TERMINATED BY A WEDGE BAR TACK

This application is related to the co-assigned application of Bajer et al, U.S. Ser. No. 434, Filed Jan. 2, 1979, and Bajer et al, U.S. Ser. No. 435, filed Jan. 2, 1979.

The present invention relates to a buttonhole bar tacker sewing machine with a device for controlling the buttonhole length terminated by a wedge bar tack, i.e. above all for controlling the length of the straight sides of the buttonhole; this is necessary in practice for sewing buttonholes for various button sizes.

Conventional sewing machines operate in such manner that the feeder continuously displaces the workpiece in one direction, the needle punches thus forming a straight seam formed by a row of straight or zigzag stitches. This principle is not applicable with machines for bar tacking buttonholes, as it would not produce the bar tacking of the required buttonhole shape. Therefore, there is used a support plate to which the workpiece is stationarily fastened by a pressing frame, and to which there is imparted from the control mechanism a motion, of which the resulting path corresponds to the required buttonhole shape. Thus, by a system of zigzag stitches formed by repeated needle punches, the resulting required contour of bar tacking the buttonhole arises. In practice, for this purpose there are particularly used cams, the rotary motion of which is transmitted by transmission elements as a reciprocatory motion to the support plate and of which the shape is established in such manner, that one revolution of the cam through 360°, i.e. back to its initial position, corresponds to the complete bar tacking of one buttonhole.

A buttonhole provided with a wedge bar tack, as shown in form of a diagram in FIG. 1, consists of straight parts a, b, an eye c, optionally provided, and a wedge bar tack d.

For bar tacking such buttonholes, a cam is built-in in the mechanism of the sewing machine for bar tacking the straight sides, a, b of the buttonhole, and one or two cams for bar tacking both the eye c and the wedge bar tack d of the buttonhole. As a rule, it is a single cam comprising on the one hand a projection for bar tacking eye c, and on the other hand two projections for forming the wedge bar tack d, usually consisting of straight sections $d_1$, $d_2$ and inclined sections $d_3$, $d_4$. The sections $d_5$, $d_6$ denote the position of stitches which would be sewn if at that phase of motion of support plate 3 the stitch forming mechanism were already in operation. However, in practice the actual sewing operation starts either at the beginning or in the course of the first straight section $d_1$, e.g. at the level denoted in FIG. 1 by the reference number $d_7$. While the cam for bar tacking the straight sides a, b of the buttonhole is permanently built-in into the sewing machine, the cam for bar tacking eye c and wedge bar tack d is arranged exchangeably when it is required to make possible the bar tacking of buttonholes with various length dimensions of the straight parts a, b and possibly with various shapes of eye c and wedge bar tack d of the buttonhole. The cam for bar tacking the straight sides a, b of the buttonhole imparts to the support plate a motion in the direction of the longitudinal axis X of the buttonhole and is thus in operation even at the phase of bar tacking eye c and wedge bar tack d, where the direction of stitches is derived from a compound motion on one side in the direction of the longitudinal axis X of the buttonhole, and on the other side in a direction transverse thereto. This motion in the transverse direction is imparted to the support plate from the active parts of the circumference of the cam for bar tacking eye c and wedge bar tack d of the buttonhole. The length of the straight parts a, b of the buttonhole thus depends upon which phase of bar tacking the cam for bar tacking the wedge bar becomes active and thus changes the seam direction from straight in a direction taken up by the stitches in the sections $d_3$, $d_4$ of wedge bar tack d (see FIG. 1).

Devices are known which for changing the length of the buttonhole provided by a wedge bar tack use a system of exchangeable cams for bar tacking the wedge bar tack. Each of these cams then defines a single length dimension of straight sides a, b of the buttonhole. Thus, this device does not make possible, on the one hand, the continuous control of the length of straight parts a, b of the buttonhole, and on the other hand is considerably expensive. Moreover, the viewpoint of easy exchangeability of these cams usually requires their fastening on an independent shaft, by which the construction of the machine is further complicated.

Another solution is known, which uses a single cam with an exchangeable position of the active parts relative to each other. If only the angular position of the cam itself were changed, without a modification of the mutual position of their active parts, the symmetry of the position of sections $d_1$, $d_2$, and sections $d_3$, $d_4$ of wedge bar tack d relative to an axis perpendicular to longitudinal axis X of the buttonhole would be necessarily disturbed. For the purpose of maintaining the required summetry, it is necessary to modify the mutual position of the active parts of the cam in such manner, that upon maintaining the original angular position of the cam body, each of both active parts thereof are displaced for the same angular value, however, in mutually opposite directions. The mechanism making this possible is very demanding, particularly as to accuracy of manufacture.

The present invention has among its objects the mitigating of the disadvantages of the present state of the art.

A preferred embodiment of the machine according to the present invention includes the following constructional arrangement.

A buttonhole bar tacker sewing machine is provided with a device for controlling the length of the buttonhole terminated by a wedge bar tack. Such machine has a support plate for the workpiece and control members for exerting its reverse motion in the direction of the longitudinal axis of the buttonhole. The control device comprises a first cam, and transversally to said direction, a second cam for forming a wedge bar tack and at least one further third cam coupled in its motion with the first cam, e.g. a cam for bar tacking the eye of the buttonhole. The second cam for bar tacking the wedge bar tack of the buttonhole is arranged on one side reversibly rotatable about its axis of rotation, and on the other side adjustable in its angular position and adjustable relative to the first cam, and further reversibly coupled in its motion with the reversible motion of the support plate in the direction of the longitudinal axis of the buttonhole, and is provided with a cam groove consisting of a section having a symmetrical course relative to the axis of rotation of the second cam for bar tacking the wedge bar tack of the buttonhole, and a further section consisting of two parts mutually offset as to their height, a roller mounted on a displaceable pin being inserted into said cam groove, said roller following in dependence of the height defined position by the position of the displaceable pin the path of either one or the other of both mutually offset parts as to their height of the cam groove and following independently of its height position the path of a symmetrical section of the cam groove, each of both said height positions of the displaceable pin being defined by the angular position of the said further cam coupled in its motion with the first cam.

A preferred embodiment of the present invention is shown in the accompanying drawings, in which.

Figure 2:
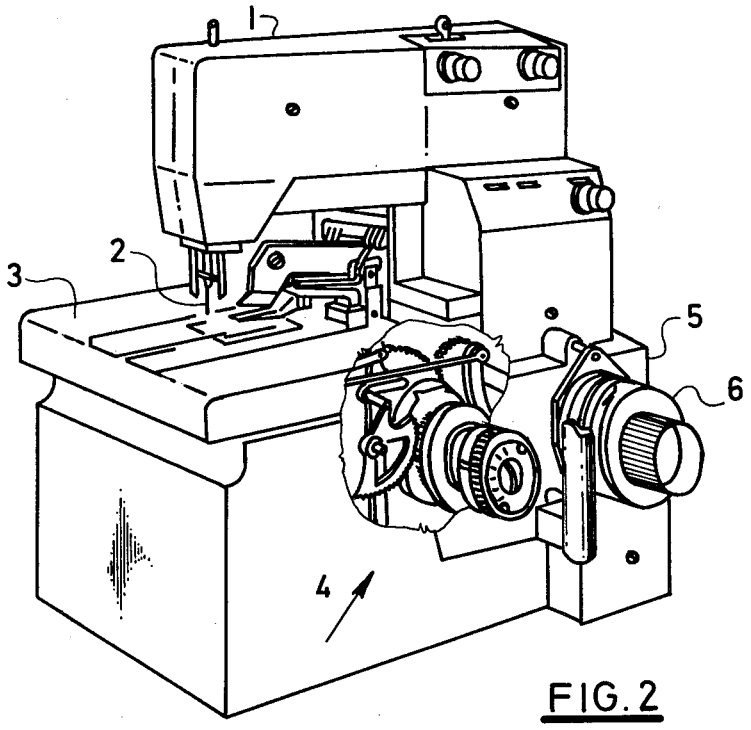
FIG. 2 is an axonometric view of the machine according to the present invention with parts broken away.

The buttonhole bar tacking sewing machine as shown in FIG. 2 comprises an overarm 1, in which there are mounted the mechanisms which are to be described further, and which impart to the needle 2 a motion usual in conventional zigzag stitch sewing machines. The machine is further provided with a device known per se, by means of which the stitch forming mechanism is turned at the phase of forming eye c of the buttonhole through the angle value dictated by the required shape of eye c of the buttonhole, usually 180°. This device, securing particularly the correct position of stitches in eye c of the buttonhole, is of no importance for the correct operation of the present invention and is thus neither described or illustrated. Further, the machine comprises a support plate 3, to which the workpiece is fastened by a passing frame (not shown), which is not a part of the present invention, and therefore also not illustrated, and a housing 5, which is arranged with its bottom in a sewing machine support (not shown). Pulley 6 is the basic driving pulley of the whole machine and is connected by a belt (not shown) to a driving unit (not shown), i.e. an electric motor. The mechanism within the lower part of housing 5 is generally designated 4. As can be seen from FIG. 3, which illustrates mechanism 4, the basic driving pulley 6 is fixed on the horizontal main shaft 7 of the sewing machine, which is mounted in bearings (not shown) and is coupled in its motion by helical gears **8*l*, 8*b* with a countershaft 9, on which there is affixed driving pulley 10, which is coupled with a pulley 12 of driving shaft 13 by a belt 11. There is imparted to needle 2 via an eccentric 14 on shaft 13, which is journaled in bearings 1' in overarm 1** and further not represented elements, a reverse vertical motion with a lateral component.

Pulley 10 is further connected by a belt 15 to a pulley 16 affixed to a lower horizontal driving shaft 17, which imparts via members (not shown) a swinging motion to a looper (not shown), which participates with needle 2 in forming zigzag stitches. On the main shaft 7 is affixed a three-sided cam 18, surrounded by a fork 19 the free end **19*a* of which is made as one integral piece with shaft 20, which is connected by a tie rod 21 with one part to an overruning clutch 22, made as a part integral with a gear 52 which is in permanent mesh with the teeth on a grooved face of box cam 24, in the cam groove of which there is permanently introduced a cam follower pin 25 of a lever 26 pivoted at its lower end at 51 to a fixed part of the housing, the other end 26*a* of lever 26 being connected to a tie rod 27, which is further connected to support plate 3. As explained in the later description of the operation of the present device, to the support plate 3** there is thus imparted, during machine operation the motion necessary for bar tacking the straight sides a, b, of the buttonhole.

The grooved cam 24 is affixed to horizontal shaft 28. A second cam 29, for forming the eye c on the buttonhole, is mounted firmly, but adjustably as to its angular position on shaft 28. A third cam 30, for forming the wedge bar tack d of the buttonhole is also mounted on shaft 28 for angular adjustment with respect thereto. The shapes of cams 29, 30 and their mutual angular position are generally similar to those in the above referred to companion applications of Bajer et al. A section of the groove in cam 29 is intended for bar tacking eye c, and sections of cam 30 are intended for bar tacking both sections $d_1$, $d_2$ of the wedge bar tack of the buttonhole. Each of cams 29, 30 has at least one further section of which the distance from the axis of rotation of the appurtenant cam is constant. The function of these latter sections will be explained upon describing the manner of operation of the machine. On shaft 28 there is affixed a cam 31, which is intended for controlling the cutting of the buttonhole, and a cam 32 intended for stopping the sewing mechanism at the end of the bar tacking cycle of the buttonhole.

Figure 4:
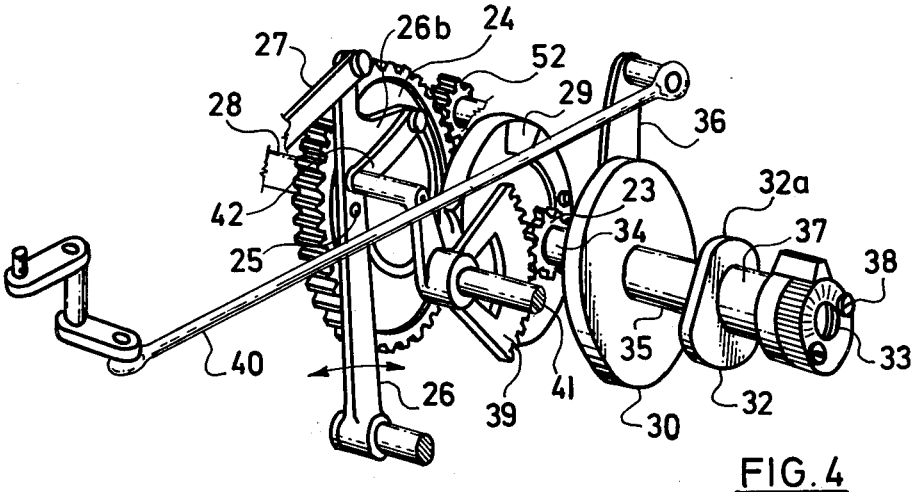
FIG. 4 is an axonometric view of a part of the control device of the sewing maching according to the present invention.
Figure 3:
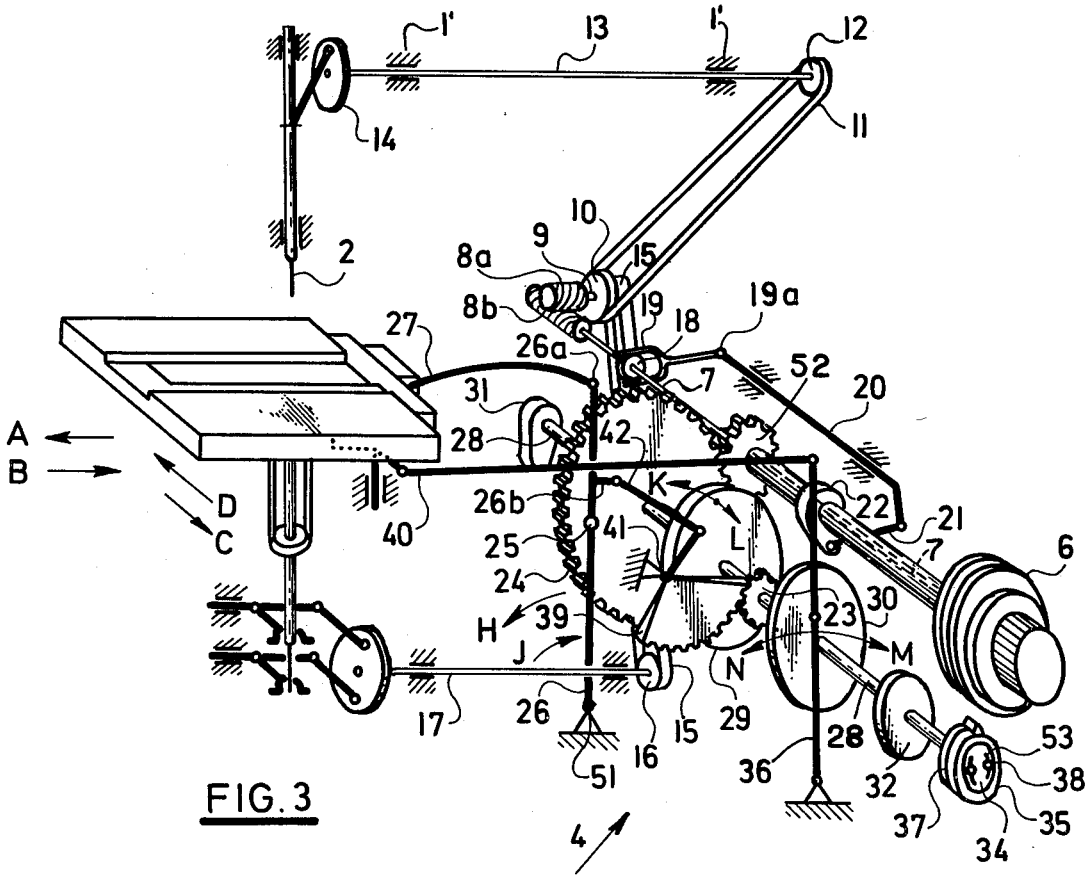
FIG. 3 is an axonometric view of the overall arrangement of the mechanism of the sewing machine according to the present invention.

Cam 31 intended for cutting the buttonhole, has no operative relation to the device according to the present invention, which would operate in exactly the same manner even in the case of so-called blind buttonholes, which are not cut at all. However, cam 32 for starting and stopping the stitch forming mechanism performs engagement and disengagement of this mechanism in a manner known per se, which is to be described further only in form of a diagram, but is coupled in its motion with the device according to the present invention in a manner, which is to be described further in a detailed way. Also cam 29 for forming the eye c of the buttonhole does not relate to that phase of the buttonhole forming to which the device according to the present invention is directed, and therefore its operation upon forming eye c of the buttonhole is not further described. As shown in FIGS. 3 and 4, a transmission lever 36 is connected by an articulated joint directly to a tie rod 40; this represents an embodiment in which cam 39 for forming eye c is disengaged from operation which proves that the device according to the present invention operates independently of whether eye c of the buttonhole is bar tacked or not. Cam 29 performs, in spite of that, within the scope of the exemplary embodiment of the device according to the present invention, a further function, which is to be described in a more detailed manner; such function could be obviously performed even by another cam fixed on shaft 28.

The device controlling the length of straight sides a, b of the buttonhole is denoted as an integral part in FIG. 2 by reference number 4. The said device is shown in a more detailed manner in FIGS. 4 and 5. On shaft 28 there is mounted slidably and idly in the direction of rotation of the shaft a first hollow shaft 34, on which is affixed a gear 23, the rotary motion and rest postion of which correspond to those of the first hollow shaft 34. On the first hollow shaft 34 there is mounted firmly, but adjustably as to its angular position a second hollow shaft 35 to which there is affixed the cam 30 for forming the wedge bar tack d. During operation of the machine, the second hollow shaft 35 thus positively participates in the rotary motion and inoperative position of the first hollow shaft 34 second hollow shaft 35. A third hollow shaft 37 is affixed, shaft 37 being adjustable in its angular position and on which there is affixed a cam 32 for starting and stopping the stitch forming mechanism of the machine even upon the continuing motion of shaft 28 of the sewing machine. This stoppage is achieved in a known manner, which does not relate to the subject matter of the present invention, by motion of not represented members, derived from the rotary motion of cam 32, whereby a clutch (not shown) is disengaged, such clutch being mounted in pulley 6, whereupon the driving of the main shaft 7 is interrupted.

Firm connection between the first, second and third hollow shafts 34, 35, 37, respectively, is achieved by means of locking screws 38, which are introduced into the grooves 53 made concentrically with the common axis of rotation of the first and second hollow shafts 34, 35 and which are screwed into threaded openings (not shown) made in the third hollow shaft 37 in such manner that upon tightening screws 38, a frictional contact sufficient for the transmission of motion without slippage is established, from the first hollow shaft 34 to the remaining two hollow shafts 35, 37. By adjusting the angular position of the second hollow shaft 35 relative to the first hollow shaft 34, the angular position of cam 30 for forming the wedge bar tack is adjusted, while by adjusting the angular position of the third hollow shaft 37 relative to the second hollow shaft 35, the angular position of cam 32 for starting and stopping the stitch forming mechanism is adjusted. The purpose and consequences of this adjustment are to be described below.

The gear wheel 23, fixed on the first hollow shaft 34, is in permanent mesh with a toothed segment 39 (FIGS. 3 and 4), which is mounted pivotally on a pivot shaft 41. One end of a tie rod 42 (FIG. 3) is connected by an articulated joint to toothed segment 39, while its other end of tie rod 42 is connected by an articulated joint to the upper end **26*b* of lever 26, from which there is derived the reverse motion of the support plate 3 in the direction of arrows A, B in FIG. 3**, as described above.

Figure 5:
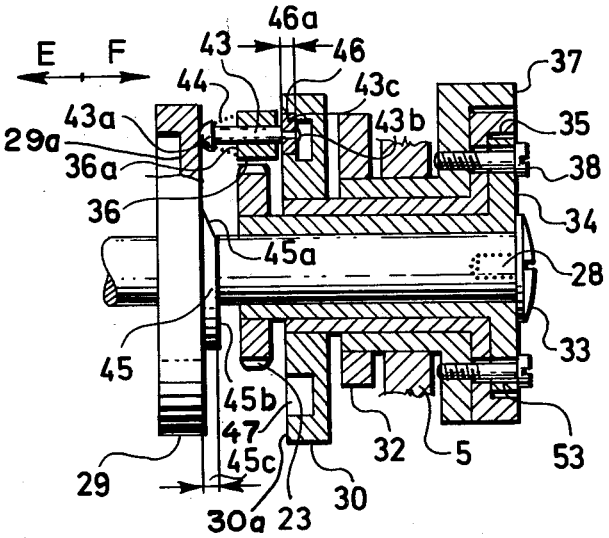
FIG. 5 is a view in vertical axial section of a part of the control device of the sewing machine according to the present invention.

As shown in FIG. 5 a horizontal passage is formed in transmission lever 36, into which is mounted displaceably in the direction of horizontal arrows E, F a horizontal displaceable headed pin 43, between the head **43*a* of the pin and the adjacent wall 36*a* of the transmission lever 36 there being inserted a coil compression spring 44, which tends to maintain the displaceable pin 43 in its extreme left position in the direction of arrow E, which might be defined e.g. by contact of head 43*a* of the displaceable pin 43 with the adjacent wall of cam 29 for forming eye c of the buttonhole. On this adjacent wall of cam 29 for bar tacking eye c there is a projection 45, either as a part integral with cam 29 for bar tacking eye c, as shown in FIGS. 4 and 5, or as an independent part which is fixed to cam 29 in any suitable manner, e.g. by screws. This projection 45 comprises, on the one hand a contacting part 45*a*, and on the other hand a straight part 45*b*. At a certain phase of turning of cam 29 for bar tacking eye c of the buttonhole, the contacting part 45*a* of projection 45 contacts the head 43*a* of displaceable pin 43 and displaces the same to the right against the action of the compression spring 44 in the direction of arrow F for a distance corresponding to the thickness 45*c* of projection 45. The device further comprises a pulley 46, which is mounted idly on displaceable pin 43 and is secured against falling down by reinforcement, e.g. riveting, of end 43*b* of the displaceable pin 43, and by a recess 43*c* made on the displaceable pin 43. The thickness 46*c* of roller 46 is slightly less than the thickness 45*c* of projection 45**.

Cam 30 for forming the wedge bar tack d is formed as a grooved cam, of which the groove 47 made in the side wall **30*a*, has a section 48, which is symmetrical relative to the axis of rotation of cam 30 and is of at least the double depth than the thickness 46*a* of roller 46, and a further section, which is now to be specified in a more detailed manner. This section consists of two parts 49, 50, of which each has a depth approximately of half the value relative to the depth of section 48 of groove 47 and thus a depth sufficient for guiding roller 46, both parts being mutually displaced as to their height. Thus roller 46, in dependence of its height position, which is influenced by the positions of displaceable pin 43, follows positively either the path of part 49 or part 50 of groove 47. Both parts 49, 50 of groove 47 are arranged mutually symmetrically relative to the axis of straight part 48 of groove 47**.

From a driving unit (not shown), rotary motion is imparted to main pulley 6, and thus also to main shaft 7, and via helical gears **8*a*, 8*b*, to countershaft 9, pulley 10, driving belt 11, pulley 12 of driving shaft 13 and eccentric 14 to needle 2**, which is driven to act together with a not represented mechanism with a motion necessary for forming a zigzag stitch.

From the pulley 10 there is imparted further via driving belt 15 a motion to pulley 16 of the driving shaft 17 of a looper (not shown).

Via the elements described above in description of the static condition of the device, to the tie rod 27 there is imparted a motion in the direction of arrows A, B, which is necessary for bar tacking the straight parts a, b of the buttonhole, such motion being derived from the shape of the grooved cam 24, which is neither described nor illustrated, since the arrangement is known per se and does not relate to the present invention. One of these elements is also lever 26, which upon starting the machine for buttonhole bar tacking is oscillated about pivot 51 fixed in the housing 5 of the sewing machine. This oscillating or shaft swinging motion takes place until the right half of eye c is bar tacked in the direction of arrow H (FIG. 3), and thereafter, until the sewing machine is stopped, in the direction of arrow J. Via tie rod 42, toothed segment 39 is thus rotated at first turning in the direction of arrow K and then in the direction of arrow L. By rotary motion of segment 39 in the direction of arrow K there is imparted a rotary motion in the direction of arrow M to gear wheel 23, the system of three hollow shafts 34, 35, 37, cam 30 for forming the wedge bar tack d, and cam 32 for starting and stopping the stitch forming mechanism.

Figure 1:
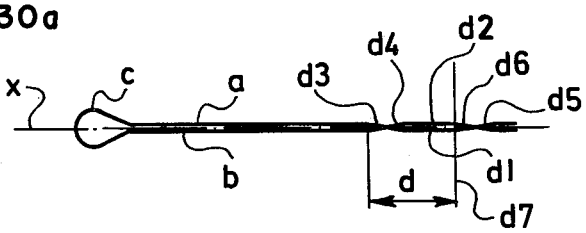
FIG. 1 is a view of the buttonhole and its separate parts in the form of a diagram.

By rotary motion of cam 32, at a predetermined angular position thereof, the driving and driven part of the clutch (not shown) mounted in pulley 6 become engaged, thus bringing into operation the stitch forming mechanism. Before starting the stitch forming mechanism, projection 45 of cam 29 for forming eye c of the buttonhole contacts the displaceable pin 43 and displaces said pin into its extreme right hand position in the direction of arrow F, in which position it is maintained by the straight part 45*b* of projection 45. Thus, roller 46 is lowered almost to the bottom, into the lower half of groove 47 made in cam 30 for forming a wedge bar tack, thus being forced thereupon, at a suitable angular position of cam 30 for forming the wedge bar tack, to follow the path of part 49 of groove 47. By the motion of roller 46 in the contacting section 49*b* of part 49 of groove 47 of cam 30 for forming the wedge bar tack, the support plate 3 is rotated via the mechanisms above described in the specification of the device in a static condition, in the direction of arrow C. This phase corresponds in FIG. 1 the section designated as $d_5$, this being a section preceding the start of the actual sewing operation. The position of this section $d_5$ expresses the direction of stitches, which would be sewn, if the stitch forming mechanism were already operative in this phase. In dependence upon the chosen angular position of cam 32, the operation of the stitch forming mechanism starts either immediately upon starting the sewing of straight section $d_1$ of the buttonhole or at any element in its course. This straight section $d_1$, derived from motion of cam 24, is sewn during the time of motion of roller 46 along the section 49*a* of part 49 of groove 47, which passes symmetrically relative to the axis of rotation of cam 30. Upon the following motion of roller 46 along the descending section 49*c*, an inclined section $d_3$ of the wedge bar tack d of the buttonhole is sewn. Upon the following contact of roller 46 with part 48 of groove 47 begins the sewing of straight side a of the buttonhole. During the time of movement of roller 46 in part 48 of groove 47 it is of no importance in which of its extreme positions, or possibly in which intermediate position, the displaceable pin 43 is situated, by the position of which is defined only the alternative between part 49 and part 50 of groove 47. The angular position of projection 45 on cam 29 as well as the length of its straight part 45*b* can be thus chosen without difficulty in such manner that it is suitable for practically all considered lengths of straight parts a, b of the buttonhole. As soon as upon motion of roller 46 in part 48 of groove 47 the displaceable pin 43 comes out of engagement with projection 45 due to the continuing rotary motion of cam 29, it is displaced by action of compression spring 44 into its extreme left position in the direction of arrow E, the following motion of roller 46 in part 50 of groove 47, and not in part 49 of groove 47 thus being predetermined.

As already mentioned above, the swinging motion of lever 26 in the direction of arrow J corresponds to the motion of the support plate 3 in the direction of arrow B i.e. the motion upon bar tacking the left side b, or possibly also the left part of eye c, and thus the rotary motion of segment 39 in the direction of arrow L, by the action of which cam 30, which rotated before in the direction of arrow M, begins to rotate in the direction of arrow N. Upon this rotary motion, roller 46 passes at first the contact section 50*b* of part 50 of groove 47. This phase corresponds to the inclined section $d_4$ of wedge bar tack d of the buttonhole. A further section 50*a* of part 50 is arranged, likewise as section 49*a* of part 49, symmetrically relative to the axis of rotation of cam 30 and corresponds to section $d_6$ of the wedge bar tack d of the buttonhole. The descending section 50*c* of part 50 of groove 47 corresponds to section $d_2$, which is almost always situated outside the range of activity of the stitch forming mechanism, of which the disengagement is derived from the corresponding angular position of cam 32, as specified above.

From the above-described embodiment it follows that the inclined section $d_4$ of wedge bar tack d of the buttonhole begins to be formed at the moment at which roller 46 contacts, upon rotary motion of cam 30 in the direction of arrow N, the contacting section 50*b* of part 50 of groove 47, while until this time, bar tacking of the straight part b of the buttonhole took place. By turning and adjustment of cam 30 relative to gear wheel 23 in the direction of arrow M, the moment of contact of roller 46 with the contacting section of part 50 of groove 47 is thus postponed, and thus the length of the straight part b of the buttonhole is extended. On the other hand, by turning and adjustment of cam 30 in the direction of arrow N, the length of the straight part b of the buttonhole is shortened. In view of the mutually symmetrical position of parts 49, 50 of groove 47, even the length of the straight part a of the buttonhole is changed by this angular adjustment of cam 30.

It is just this, in which resides the substantial advance of the device of the present invention with respect to the present state of art: that at an arbitrary angular position of cam 30, mutual symmetry is automatically secured, along longitudinal axis X of the buttonhole, as well as in the direction perpendicular to said axis X, the straight part a relative to straight part b, inclined part $d_3$ relative to inclined part $d_4$, and the straight part $d_1$ relative to straight part $d_2$ of wedge bar tack d of the buttonhole, any further adjustment upon changing the length of the straight part of the buttonhole thus being unnecessary.

Figure 6:
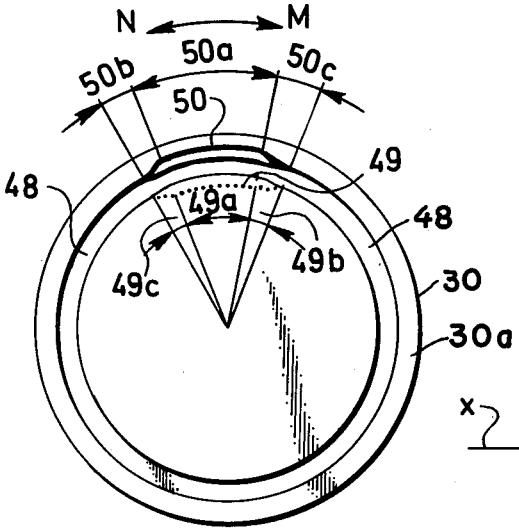
FIG. 6 is a front view of the front surface of the cam for bar tacking the wedge bar tack of the buttonhole.
Figure 7:
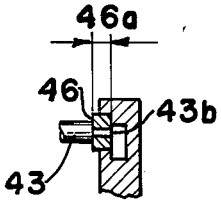
FIG. 7 is a view of a part of the control device shown in FIG. 5.

The change of the angular position of cam 30 for forming the wedge bar tack d relative to gear 23 can be accomplished upon loosening the locking screws 38 by turning the second hollow shaft 35 relative to the first hollow shaft 34. When the third hollow shaft 37 is to participate in the turning of second hollow shaft 35, its angular position is thus changed in that sense relative to the first hollow shaft 34 for the same value, the preceding length of sections $d_1$, $d_2$ is to be maintained even upon new adjustment, i.e. the length of actually bar tacked straight parts of wedge bar tack d of the buttonhole, as by corresponding turning of the second and third hollow shafts 35, 37 the spatial relation between cam 32 for starting and stopping the stitch forming mechanism and cam 30 for forming the wedge bar tack d is maintained. If shortening or even omission of wedge bar tack d is required, the third hollow shaft 37 is turned relative to the second hollow shaft 35 in the direction of arrow N (FIG. 6). As shown in FIG. 5 all three hollow shafts 34, 35, 37 are extended outside the machine body, and are thus controllable from outside.

The described embodiment admits to various modifications in construction, e.g. for the operation as such, the arrangement with a single idly mounted shaft would be sufficient, on which the cam for forming the wedge bar tack on one side, and the cam for starting and stopping the stitch forming mechanism on the other side would be fixed, and which would be coupled in its motion, by means of a segment and a gear, or in any other manner, with a mechanism imparting to the support plate 3 a motion in the direction of the longitudinal axis of the buttonhole. For controlling the length of the straight parts a, b of the buttonhole, it is not necessary that parts 49, 50 of groove 47 should be arranged symmetrically relative to the axis of symmetrical part 48 of groove 47. The symmetrical arrangement of parts 49, 50 is necessary only for the symmetric course of sections $d_3$, $d_4$ of the wedge bar tack d of the buttonhole. A progress in view of the present state of art would have been made even by an arrangement in which cam 30 for forming the wedge bar tack d would be arranged relative to the first cam 24 adjustable in its angular position, though not continuously, but at small intervals, which would be practically suitable for the separate required lengths of straight parts a, b of the buttonhole. The above mentioned and various further modifications are not described there in a more detailed manner, as they are fully within the scope of the present invention.

Although the invention is illustrated and described with reference to a plurality of preferred embodiments thereof, it is to be expressly understood that it is in no way limited to the disclosure of such a plurality of preferred embodiments, but is capable of numerous modifications within the scope of the appended claims.

What is claimed is:

1. In a buttonhole bar tacker sewing machine having an overarm, a support plate for the workpiece, control members for exerting a reverse motion upon the support plate in the direction of the longitudinal axis of the buttonhole, and a device for controlling the length of the buttonhole terminated by a wedge bar tack, the improvement which comprises a first cam for reciprocating the support plate in the direction of the longitudinal axis of the buttonhole, a second cam for forming a wedge bar tack, and at least one further, third cam coupled in its motion with the first cam, said further cam being arranged on the one hand reversibly and rotatably about its axis of rotation, and on the other hand adjustably in its angular position and adjustable relative to the first cam, the second cam being reversibly coupled in its motion with a reversible motion of the support plate in the direction of the longitudinal axis of the buttonhole, the third cam being provided with a cam groove consisting of a section having a symmetrical course relative to the axis of rotation of the second cam for bar tacking the wedge bar tack of the buttonhole, and a further section consisting of two parts mutually offset as to their radial height, a roller mounted on a displaceable pin being inserted in said cam groove, said roller following, in dependence upon its height position defined by the position of the displaceable pin, the path of either one or the other of the two parts mutually offset as to the height of the cam groove and following independently of its height position the path of the symmetrical section of the cam groove, each of the two height positions of the displaceable pin being defined by the angular position of the said further, third cam coupled in its motion with the first cam.

2. A buttonhole bar tacking sewing machine in accordance with claim 1, wherein the two mutually offset parts of the cam groove are arranged mutually symmetrically relative to the axis of the symmetrical sections of said cam groove.

3. A buttonhole bar tacker sewing machine in accordance with claim 1, wherein each of the mutually offset parts of the cam groove comprises on one side a section which is symmetrical relative to the axis of rotation of a second cam for bar tacking the wedge bar tack of the buttonhole, and on the other side a contact section and a descending section.

4. A buttonhole bar tacker sewing machine in accordance with claim 1, comprising a first hollow shaft bearing a gear affixed thereto, such gear being in permanent mesh with a toothed segment which is in turn coupled in its motion with a lever forming one element of the mechanism for imparting to the support plate a reversible motion in the direction of the longitudinal axis of the buttonhole, said first hollow shaft being mounted slidably in the direction of rotation of the shaft which during the operation of the machine rotates in one direction, the first cam as well as the said further cam being coupled in their motion with said first cam being fixed on the first hollow shaft, and a second hollow shaft coaxially mounted on the first hollow shaft and firmly but adjustably affixed thereto as to its angular position on the first hollow shaft, the second cam for bar tacking the wedge bar tack of the buttonhole being affixed to the first hollow shaft, and a cam for starting and stopping the stitch forming mechanism fixedly mounted upon the first hollow shaft.

5. A buttonhole bar tacker sewing machine in accordance with claim 1, comprising a first hollow shaft on which there is affixed a gear which is in permanent mesh with a toothed segment coupled in its motion to a lever forming one of the elements of a mechanism for imparting motion in the direction of the longitudinal axis of the buttonhole to the support plate, the first hollow shaft being slidably mounted in the direction of rotation on a central shaft bearing the cams, such central shaft rotating in one direction during the operation of the machine, the said first cam as well as the said further, third cam being mounted on said central shaft and being coupled in its motion with said first cam, and a second hollow shaft mounted coaxially on the first hollow shaft but adjustable as to its angular position with respect thereto, the second cam for bar tacking the wedge bar tack of the buttonhole being fixed thereon, and a third hollow shaft mounted firmly coaxially on the second hollow shaft but adjustable as to its angular position with respect thereto, and a cam for starting and stopping the stitch forming mechanism of the machine firmly mounted on said third hollow shaft.

6. A buttonhole bar tacker sewing machine in accordance with claim 4, wherein all of the first, second, and third hollow shafts are extended outside the body of the sewing machine.

* * * * *

UNITED STATES PATENT AND TRADEMARK OFFICE

CERTIFICATE OF CORRECTION

PATENT NO. : 4,181,084

DATED : January 1, 1980

INVENTOR(S) : Frantisek Bajer et al.

It is certified that error appears in the above-identified patent and that said Letters Patent are hereby corrected as shown below:

On page 3 of the patent document, please correct inventor's name in two places from:

Bajek et al (top of page on left side)

to

Bajer et al

[75] Inventors: Frantisek Bajerk to

[75] Inventors: Frantisek Bajer;

Signed and Sealed this

*Fifteenth* Day of *April 1980*

[SEAL]

*Attest:*

SIDNEY A. DIAMOND

*Attesting Officer*

*Commissioner of Patents and Trademarks*